United States Patent [19]

Richmond

[11] 4,368,127

[45] Jan. 11, 1983

[54] FABRIC SOFTENING COMPOUNDS AND METHOD

[75] Inventor: James M. Richmond, Naperville, Ill.

[73] Assignee: Akzona Incorporated, Asheville, N.C.

[21] Appl. No.: 164,705

[22] Filed: Jun. 30, 1980

Related U.S. Application Data

[62] Division of Ser. No. 54,341, Jul. 2, 1979.

[51] Int. Cl.[3] ..... D06M 13/46

[52] U.S. Cl. ..... 252/8.8; 560/252; 560/253; 424/70; 424/365; 252/355; 252/387

[58] Field of Search ..... 252/8.8

[56] References Cited

U.S. PATENT DOCUMENTS

| | | | |
|---|---|---|---|
| 2,189,397 | 2/1940 | Harris | 560/100 |
| 2,333,770 | 11/1943 | Dickey et al. | 560/253 |
| 2,653,156 | 9/1953 | Deutsch et al. | 560/253 |
| 2,775,604 | 12/1956 | Zech | 564/285 |
| 2,824,861 | 2/1958 | Conbere et al. | 526/310 |
| 3,026,169 | 3/1962 | Eskridge | 264/197 |
| 3,352,709 | 11/1967 | Gunnar et al. | 106/13 |
| 3,456,013 | 7/1969 | Egan et al. | 252/51.5 R |
| 3,729,416 | 4/1973 | Brüning et al. | 560/222 |
| 3,872,138 | 3/1975 | Ogata | 560/1 |
| 3,989,711 | 11/1976 | Bodor | 560/253 |
| 3,998,875 | 12/1976 | Bodor | 560/253 |
| 4,118,324 | 10/1978 | Steckelberg | 252/8.9 |
| 4,128,485 | 12/1978 | Bauman et al. | 560/253 |
| 4,129,506 | 12/1978 | Wallhausser et al. | 252/8.8 |
| 4,134,970 | 1/1979 | Panke et al. | 424/70 |
| 4,136,039 | 1/1979 | Jager et al. | 252/8.9 |
| 4,139,477 | 2/1979 | Hayek et al. | 252/8.6 |
| 4,237,155 | 12/1980 | Kardouche | 427/242 |

FOREIGN PATENT DOCUMENTS

| | | | |
|---|---|---|---|
| 7135 | 1/1980 | European Pat. Off. | 252/8.8 |
| 2025944 | 12/1971 | Fed. Rep. of Germany | 252/8.8 |
| 1302794 | 1/1973 | United Kingdom . | |
| 1330203 | 9/1973 | United Kingdom . | |

*Primary Examiner*—Maria Parrish Tungol

*Attorney, Agent, or Firm*—Francis W. Young; Robert F. Green

[57] ABSTRACT

Novel fabric softening compounds of the formulae wherein $R_1$ and $R_2$ are independently selected from the group consisting of aliphatic radicals containing from about 8 to about 22 carbon atoms, $R_3$ and $R_4$ are independently selected from the group consisting of hydrogen and methyl, $R_5$ is selected from the group consisting of hydrogen and aliphatic radicals containing from about 8 to about 22 carbon atoms, x and y are independently integers from 1 to about 20, and z is 0 or 1, are disclosed. Also disclosed is a method for conditioning textiles utilizing said compounds.

5 Claims, 2 Drawing Figures

FIG. I
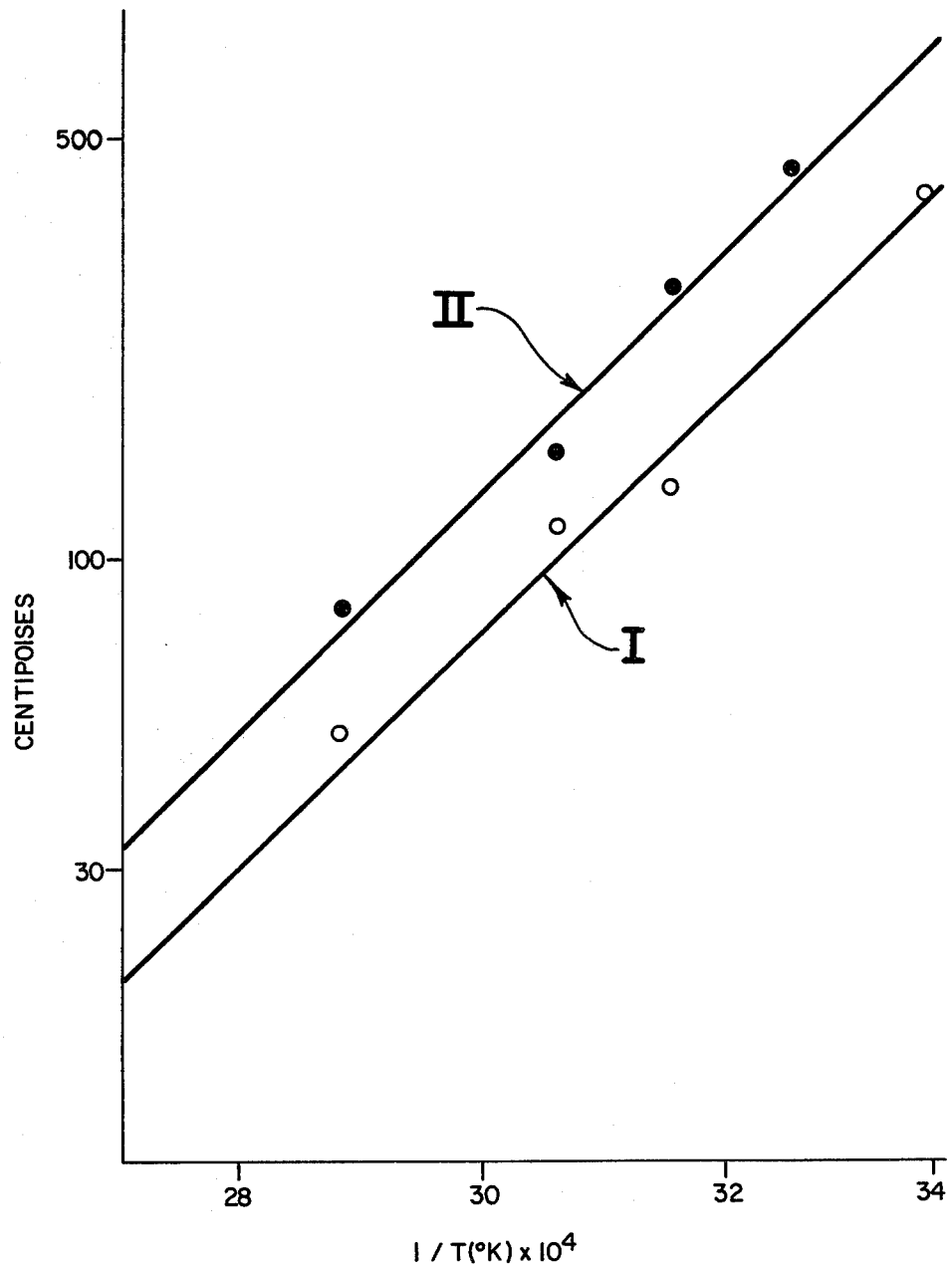

FIG. II
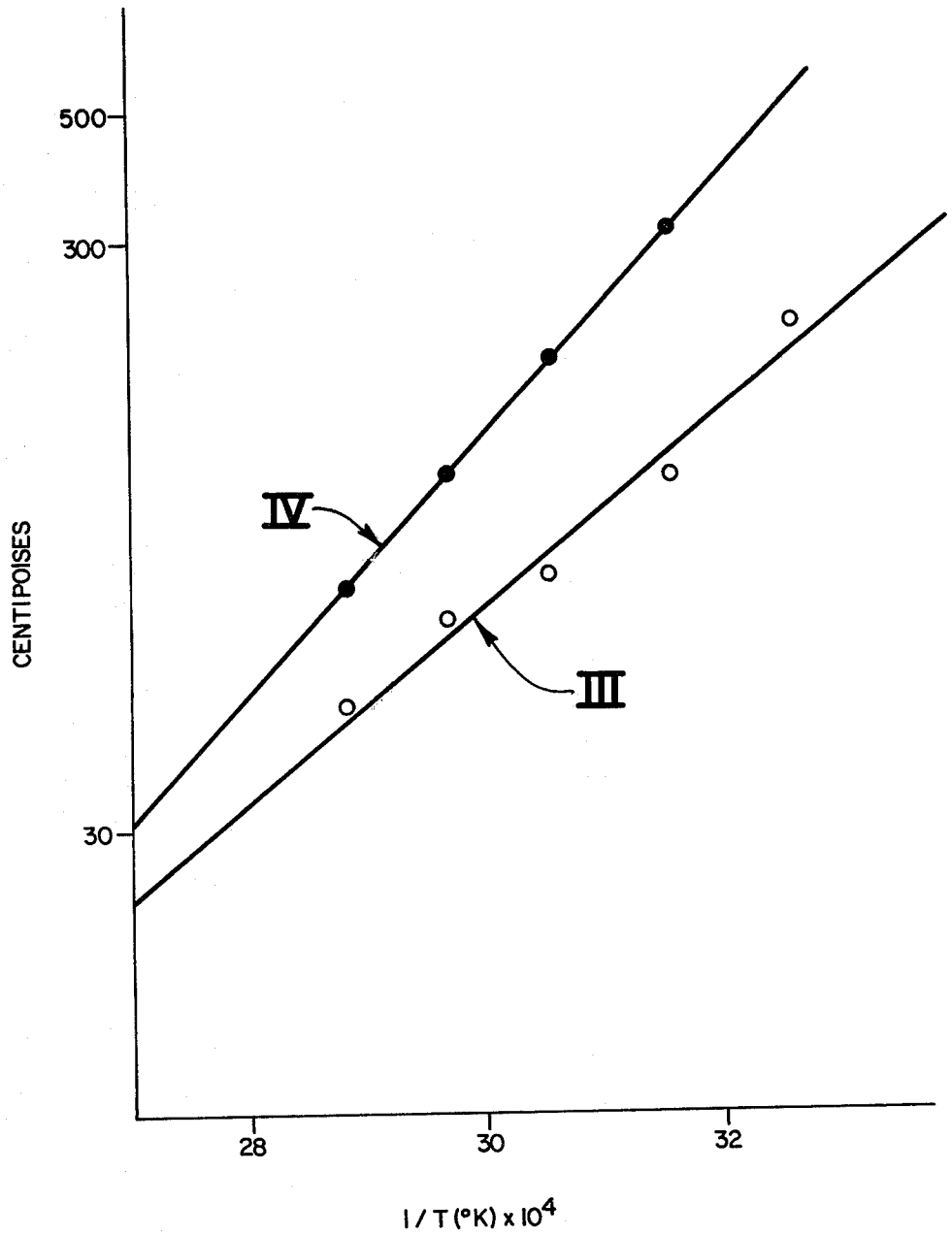

FABRIC SOFTENING COMPOUNDS AND METHOD

This is a division of application Ser. No. 054,341, filed July 2, 1979.

BACKGROUND OF THE INVENTION

This invention relates to fabric softening compounds and to a method for softening textiles. More particularly this invention relates to certain quaternary ammonium compounds and their use in softening textiles.

Quaternary ammonium compounds and their use in softening textiles or conditioning other substrates such as hair have been long recognized in the prior art. Such quaternary ammonium compounds which have alkoxy groups, such as ethoxy, attached to the quaternary nitrogen atom have also been known in the art. In this respect, reference may be made to U.S. Pat. Nos. 2,189,397, 2,775,604, 2,824,861, 3,026,169, 3,352,709, 3,456,013, 3,872,138, 4,118,324, 4,129,506, 4,134,970, 4,136,039, and 4,139,477.

One of the properties of concern to users of such quaternary ammonium compounds is the liquidity of the product. Thus, it is desirable that fabric softening compounds be as liquid as possible to reduce the necessity, for example, of utilizing heated railroad cars for transportation of the bulk compound, or the use of heated holding tanks and transfer lines to assure that the compound is maintained in a liquid state. This is especially true in view of the recent desirability to minimize the energy which is needed for any type of processing. Therefore, if a more liquid product is produced, the amount of energy required to transport and store the product is minimized. Also, liquid products are generally cold water dispersible, negating the need to heat water to make diluted solutions or dispersions of the concentrated softener.

It is, therefore, an object of the invention to provide quaternary ammonium compounds which exhibit increased liquidity over other prior art compounds.

Also, as many of the quaternary ammonium compounds which are known in the art are chloride salts which are known to have corrosive properties, an object of this invention is to provide quaternary ammonium compounds which are less corrosive.

A further object is to produce compounds free of volatile and flammable solvents that serve only as a reaction media and have no value for providing softening.

SUMMARY OF THE INVENTION

It has now been surprisingly discovered that if a quaternary ammonium compound is produced having attached to the quaternary nitrogen an alkoxy group which has been esterified to form an acetate ester, the acetate salt thereof will be more liquid than the corresponding acetate in which the alkoxy group has not been esterified. The acetate salts of this invention are less corrosive than their chloride salt analogs. Thus, the present invention provides novel compounds of the following formulae

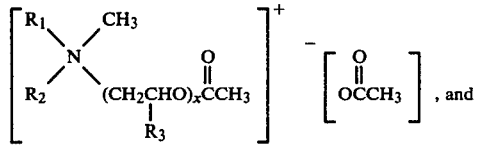

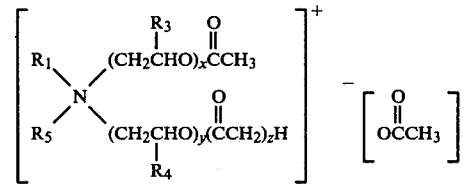

wherein $R_1$ and $R_2$ are independently selected from the group consisting of aliphatic radicals containing from about 8 to about 22 carbon atoms, $R_3$ and $R_4$ are independently selected from the group consisting of hydrogen and methyl, $R_5$ is selected from the group consisting of hydrogen and aliphatic radicals containing from about 8 to about 22 carbon atoms, x and y are independently integers from 1 to about 20, and z is 0 or 1.

Also, provided is a method for softening textiles comprising contacting said textiles with an effective amount of a compound of one of the foregoing formulae. Typically the textiles are contacted with the compound which is in the form of a solution.

DESCRIPTION OF THE PREFERRED EMBODIMENTS

In the compounds of the present invention which are described hereinabove it is generally desirable that the alkoxy group in the cationic moiety be an ethoxy, propoxy, or mixed ethoxy/propoxy group. Of course, if a mixed group is utilized, the chain may be either random or block. As indicated, such an alkoxy chain may contain from 1 to about 20 alkoxy units, typically from about 1 to about 5, and preferably about 1 alkoxy unit.

The long chain aliphatic groups present in the cationic moiety as indicated contain from about 8 to about 22 carbon atoms. Preferably, the aliphatic groups contain from about 12 to about 18 carbon atoms. The aliphatic groups may be either saturated groups, and thus alkyl, or may be unsaturated groups, and thus alkenyl. Typically, such groups are derived from, for example, animal fatty acids such as tallow fatty acids or grease acids (from hog fat), hydrogenated tallow fatty acids, and coconut fatty acids.

The preparation of such quaternary ammonium compounds is relatively simply. First, one may start with the corresponding tertiary amine which may be reacted with acetic acid and the corresponding alkylene oxide such as ethylene or propylene oxide, in the presence of water. It has been found that some minimum amount of water is necessary to the reaction. Typically, the reaction would be performed in a closed reaction vessel at a temperature of about 80° C. and under a pressure of about 50 psig. The reaction times will vary, but typically will be on the order of about 6 hours. The product obtained from such a reaction will contain approximately 5% of the quaternary ammonium acetate salt having an acetate ester group in the cationic moiety. To increase the yield of the acetate ester salt, one may further react the aforementioned reaction product, preferably after removal of the residual volatiles as through heating under reduced pressure, with acetic anhydride. Again, preferably, the product is heated under reduced pressure to remove remaining volatiles and the desired product recovered.

As mentioned, the products of this invention are useful in softening textile materials. Because the products exhibit increased liquidity, they are more desirable than their non-esterified counterparts. Also, as the quaternary ammonium compounds of the present invention are all acetate salts, rather than, for example, chloride salts, they are believed to exhibit reduced tendencies to corrode materials, such as metals, with which they may come in contact. Typically, the compounds may exist as solutions, as in ethylene glycol containing about 50 to 75% of quaternary ammonium compound, by weight. As ethylene glycol is produced in the ethoxylation reaction it is a convenient solvent. The solutions may also contain hexylene glycol as an additional solvent.

Another advantage of the products of the instant invention is that although they soften textiles, they are capable of rendering them more hydrophobic than other quaternary ammonium compounds, thus making them especially desirable for softening textiles which are to be utilized in applications such as rainwear.

The compounds of this invention also may be useful as precipitants are carriers for use in the manufacture of antibiotics. The compounds may also be used as combing aids and hair conditioners and in paper making as softeners, debonders, and antistatic agents. Furthermore, the compounds may be used as processing aids in foundries, in metal-working as emulsifiers and corrosion inhibitors and in surface modified clays, paints, oils, and lubricants.

This invention is described in more detail in the following non-limiting examples.

EXAMPLE 1

To a one-liter 316-stainless steel Parr pressure reactor was charged methyldi(hydrogenated tallow)amine (Armeen® M2HT, from Armak Company, Chicago, Illinois) (529 g, 1.0 gmol), glacial acetic acid (60.0 g, 1.0 gmol), water (54.0 g, 3.0 gmol). This mixture was heated to 80° C., the reactor vent closed and ethylene oxide admitted (220 g, 5.0 gmol). This reaction mixture was heated at 80° C. for about six hours as the reactor pressure decayed from 50 psig. Aliquots of this final mixture were analyzed and 2.38% of unreacted amine, 86.63% of quaternary and no amine acetate salt were found. This mixture had a pH of 8.67, while 3.9% ethylene glycol, 4.2% diethylene glycol, 0.8% triethylene glycol, and 0.16% water was found. This final mixture had a melting range of 34°–37° C., a pour point of 37° C., and was a paste at room temperature. Quaternary was isolated from this mixture and was shown to be a 95:5 mixture of the following structures IV and III, respectively, wherein $R_{HT}$ represents the aliphatic radicals obtained from hydrogenated tallow fatty acids:

IV.

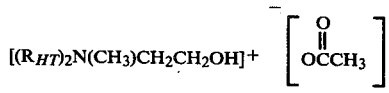

III.

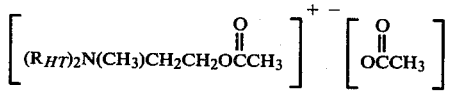

EXAMPLE 2

To 300 g of the final mixture prepared from Example 1 in a glass vessel was added acetic anhydride (58.8 g, 0.576 gmols) and the mixture placed on a steam bath for about two hours. The volatiles were then removed from this reaction mixture with heat and reduced pressure provided by a vacuum pump. The product was analyzed and the quaternary present found to be predominately that of Structure III as described in Example 1. This material had a melting range of 28°–35° C., a pour point of 35° C. and was a paste at room temperature.

EXAMPLE 3

To a one-liter 316-stainless steel Parr pressure reactor was charged ditallowamine (Armeen® 2T, from Armak Company, Chicago, Illinois), (450 g; 0.88 gmol), glacial acetic acid (52.8 g; 0.88 gmol), water (54.0 g; 3.0 gmol), and (8.36 g, 0.044 gmol). This mixture was heated to 80° C., the reactor vent closed, and ethylene oxide added (155 g; 3.5 gmol). This mixture was heated at 80° C. for about 8 hours as the reactor pressure decayed from 50 psig. Analysis of this product showed 5.8% of unreacted amine, no amine acetate salt, and 69.8% quaternary identified as that of Structure II, hereinbelow. This product was a very viscous liquid at room temperature and had a pour point of 24° C. Quaternary was isolated from an aliquot of this product and was shown to be a mixture of the following Structures IA, IB and II in a ratio of IA and IB to II of 7:100, respectively, wherein $R_T$ represents the aliphatic radicals obtained from tallow fatty acids:

IA.

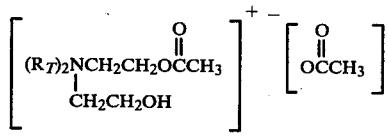

IB.

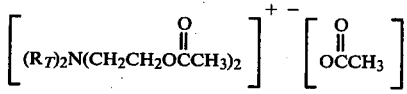

II.

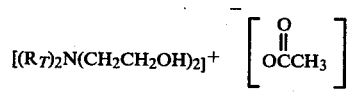

EXAMPLE 4

A portion of the product of Example 3 was placed in a glass vessel and the volatiles removed with heat and reduced pressure provided by a vacuum pump. To 243.5 g of this residue was added 61.2 g of acetic anhydride and the mixture heated on the steam bath for about two hours. Volatiles were then removed from this mixture with heat and reduced pressure provided by a vacuum pump. This product was a thin liquid at room temperature, and had a pour point of 7° C. Quaternary of this product was analyzed as predominately that of Structures IA and IB as described in Example 3.

The compositions of the foregoing examples were analyzed with respect to their viscosities, poor points, melting ranges, and physical states at room temperature. FIG. I is a plot of the viscosity of the products identified as having structures IA and IB and plot of the viscosity of the product having the structure identified as II. The viscosities were measured with a Brookfield (rvf) viscometer, utilizing spindle number 3 at 10 revolutions per minute. Similarly, FIG. II is a plot of the viscosities for the compositions having structures III and IV. The data is compiled in Table I which shows that the quaternary ammonium acetate salts possessing acetate ester groups in the cationic moiety were consistently lower in viscosity than the corresponding acetate salts which did not possess such acetate ester groups. Thus the compound of structure IA and IB were consistently lower in viscosity than the compound of structure II and the compound of structure III was consistently lower in viscosity than the compound of structure IV. Table II summarizes the pour point, melting ranges, and physical states for compounds possessing the 4 structures. Again, the compounds of structures I and III consistently demonstrated a higher degree of liquidity than the compounds of structures II and IV, respectively.

TABLE I

| TEMPERATURE (°C.) | VISCOSITY - CENTIPOISES STRUCTURE I | II | III | IV |
|---|---|---|---|---|
| 25 | 410 | 3250* | — | — |
| 35 | 230 | 440 | 230 | — |
| 45 | 130 | 280 | 125 | 330 |
| 55 | 110 | 150 | 85 | 100 |
| 65 | 60 | 110 | 70 | 125 |
| 75 | 50 | 80 | 50 | 80 |
| A (y-intercept) | −8.765 | −9.114 | −7.390 | −10.643 |
| B (slope) | 4381 | 4674 | 3916 | 5228 |
| Correlation Coefficient | 0.9909 | 0.9940 | 0.9858 | 1.000 |

*EXCLUDED FROM CORRELATION OF $\ln n = A + B/T$

TABLE II

| | STRUCTURE I | II | III | IV |
|---|---|---|---|---|
| POUR POINTS, °C. | 7 | 24 | 35 | 37 |
| MELTING RANGE, °C. | — | — | 28–35 | 34–37 |
| PHYSICAL STATE | Thin | Viscous | Paste | Paste |

TABLE II-continued

| | STRUCTURE I | II | III | IV |
|---|---|---|---|---|
| AT R.T. | Liquid | Liquid | | |

IA = $T_2\overset{\oplus}{N}(CH_2CH_2OH)CH_2CH_2OAC\ OAC^{\ominus}$

IB = $T_2\overset{\oplus\oplus}{N}(CH_2CH_2OAC)_2\ OAC^{\ominus}$

II = $T_2\overset{\oplus}{N}(CH_2CH_2OH)_2\ OAC^{\ominus}$

III = $(HT)_2\overset{\oplus}{N}(CH_3)CH_2CH_2OAC\ OAC^{\ominus}$

IV = $(HT)_2\overset{\oplus}{N}(CH_3)CH_2CH_2OH\ OAC^{\ominus}$

What is claimed is:

1. A method for softening textiles comprising contacting said textiles with an effective amount of a compound of the formula

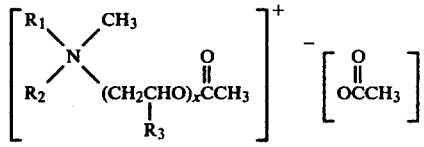

wherein $R_1$ and $R_2$ are independently selected from the group consisting of alkyl and alkenyl groups containing from about 8 to about 22 carbon atoms, $R_3$ is selected from the group consisting of hydrogen and methyl, and x is an integer from 1 to about 20.

2. A method for softening textiles comprising contacting said textiles with an effective amount of a compound of the formula:

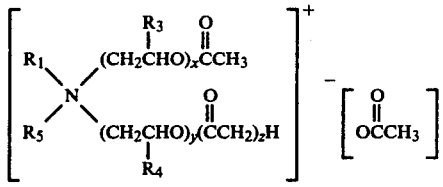

wherein $R_1$ is selected from the group consisting of alkyl and alkenyl groups containing from about 8 to about 22 carbon atoms, $R_3$ and $R_4$ are independently selected from the group consisting of hydrogen and methyl, $R_5$ is selected from the group consisting of hydrogen and alkyl and alkenyl groups containing from about 8 to about 22 carbon atoms, x and y are independently integers from 1 to about 20, and z is 0 or 1.

3. The method of claim 1 wherein x is 1 and $R_3$ is hydrogen.

4. The method of claim 2 wherein x and y are 1 and $R_3$ and $R_4$ are hydrogen.

5. The method of claim 1, 2, 3, or 4, wherein the textile is contacted with the compound in the form of a solution.

* * * * *